US006422809B1

(12) United States Patent
Filippov et al.

(10) Patent No.: US 6,422,809 B1
(45) Date of Patent: Jul. 23, 2002

(54) GAS TURBINE ARRANGEMENT

(75) Inventors: Vladimir Filippov, Moscow (RU); Agne Karlsson, Ljungsbro (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/701,144

(22) PCT Filed: May 25, 1999

(86) PCT No.: PCT/SE99/00884

§ 371 (c)(1),
(2), (4) Date: Feb. 2, 2001

(87) PCT Pub. No.: WO99/61755

PCT Pub. Date: Dec. 2, 1999

(30) Foreign Application Priority Data

May 25, 1998 (SE) ..... 9801824

(51) Int. Cl.[7] ..... F01D 5/08
(52) U.S. Cl. ..... 415/107; 416/97 R
(58) Field of Search ..... 415/96, 104, 107, 415/115; 416/96 R, 97 R

(56) References Cited

U.S. PATENT DOCUMENTS 3,635,586 A * 1/1972 Kent et al. ..... 416/97
4,653,267 A 3/1987 Brodell et al.
5,154,048 A 10/1992 Ponziani et al.
5,167,484 A 12/1992 Ponziani et al.

* cited by examiner

*Primary Examiner*—Edward K. Look
*Assistant Examiner*—Dwayne J. White
(74) *Attorney, Agent, or Firm*—Burns, Doane, Swecker & Mathis, L.L.P.

(57) ABSTRACT

A gas turbine arrangement includes a compressor (2) with a compressor rotor (7), a turbine (3) with a turbine rotor (12) and connected with the compressor (2), and a balancing member (18) connected with the turbine rotor (12) and arranged to counteract axial forces generated by the compressor rotor (7) and the turbine rotor (12). The balancing member (18) is arranged to be activated by a pressure fluid. The arrangement includes at least one channel (26) which is arranged to lead at least a part of the pressure fluid used for activation to at least a part of the turbine (3) for influencing the temperature of the turbine part, and where the part of the turbine (3) is a rotor portion (13), wherein the balancing member (18) is attached to that end of the turbine rotor (12) which is located downstream, and where the channel (26) leads to a space (25) which is formed between the end of the turbine rotor (3) and the balancing member (18).

9 Claims, 2 Drawing Sheets

GAS TURBINE ARRANGEMENT

BACKGROUND OF THE INVENTION AND PRIOR ART

Figure 1:
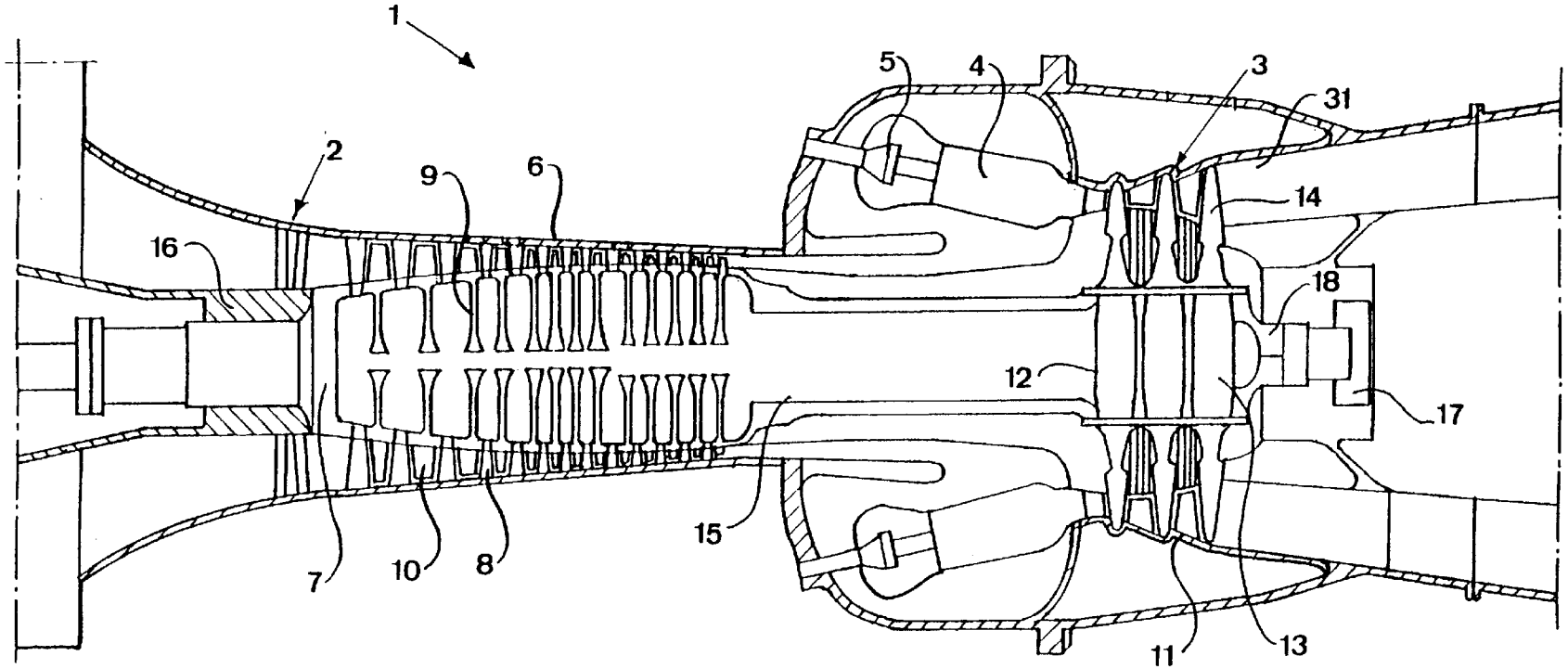

The present invention concerns a gas turbine arrangement, comprising a compressor, with a rotor, a turbine, with a rotor and connected with the compressor, and a balancing member connected with the turbine rotor and arranged to counteract axial forces generated by the compressor rotor and the turbine rotor, wherein the balancing member is arranged to be activated by means of a pressure fluid.

In such gas turbine arrangements according to the prior art, the compressor rotor is usually coaxial with and connected to the turbine rotor. The compressor rotor and the turbine rotor are thereby usually carried in bearings which are arranged in the area of the opposite ends of the two rotors.

Since the compressor rotor and the turbine rotor usually have different kinds of blades, and, furthermore, since a higher power is usually produced by the turbine rotor, the axial forces which are generated by the two rotors and which are directed in opposite directions will not completely cancel each other. Consequently, a resulting axial force exists. In order to reduce the load on the axial bearing or bearings which will carry said resulting axial force, gas turbine arrangements according to the prior art are therefore provided with a balancing piston which is coaxial with the rotors and attached to that end of the turbine rotor which is turned away from the compressor rotor. The balance piston may thereby be formed by a disk-shaped piece which is integrated with an axle which via this piece is connected with and projects from the turbine rotor. In order to generate an axial force in the balancing piston, a part of the compressor air which is drawn off from the compressor for cooling purposes is conducted to the balancing piston and is allowed to exercise a force on the side of the balancing piston which is turned away from the turbine rotor. It is thereby even possible to exclude an axial bearing in this end of the compressor rotor/turbine rotor unit.

The compressor air which is used for the activation of the balancing piston is allowed to an as low extent as possible to flow out in the main flow channel of the turbine after having served its purpose. Any further utilisation of the compressor air does not take place.

SUMMARY OF THE INVENTION

A purpose with the present invention is to achieve a gas turbine arrangement which is arranged such that the pressure fluid which is used for activating a balancing member is used in such a way that a reduction of the total amount of compressor air which is drained off for, inter alia, cooling purposes in the gas turbine arrangement is possible or that a higher influence of the temperature of components included in the turbine is possible by means of a given amount of drained off compressor air. With "influence of temperature" is here meant primarily cooling, but also heating of certain components during certain phases of operation may be desired and may take place.

This purpose is achieved with a gas turbine arrangement as initially defined, which is charaterized in that it comprises at least one channel which is arranged to lead at least a part of the pressure fluid used for said activation to at least a part of the turbine for influencing the temperature of the same. With influencing the temperature primarily cooling is meant, but it is of course also possible to use the pressure fluid for heating said part of the turbine if this is found to be advantageous.

According to a preferred embodiment, said part of the turbine is a rotor portion. Thereby the possibility is achieved, that by means of the pressure fluid cooling of the rotor portion is accomplished, which is desirable.

According to a preferred embodiment, the rotor portion is a rotor disk. Usually a cooling of the rotor disks of the turbine is desirable or necessary. Specific constructional solutions are however necessary in order to conduct cooling air to all of these. The use of the pressure fluid of the balancing member, which pressure fluid preferably comprises drained off compressor air, for influencing the temperature of one or more of the rotor disks of the turbine permits technically simple solutions for the conduction of the pressure fluid to the rotor disks, in particular since the balancing member suitably is arranged in association with the rotor disks.

According to a further preferred embodiment, the balancing member is attached to an end of the turbine rotor and said channel leads to a space formed between the end of the rotor and the balancing member. Thereby an appropriate cooling of the last one in a row of rotor disks is achieved.

According to a further preferred embodiment, the gas turbine arrangement comprises at least one leakage passage, arranged to allow leakage of the pressure fluid which has been used for said influence of temperature into a main flow channel in the turbine. Thereby a continuous flow of the pressure fluid into and through the space mentioned before is achieved. Furthermore, an advantageous cooling of that surface of the balancing member which together with said rotor disk define said space between the two is achieved.

According to a further preferred embodiment, the balancing member comprises an axle, which is coaxial with the turbine rotor and attached to the turbine rotor at the downstream end of the same. In a known manner the axle may comprise a disk-shaped piece, via which it is attached to the turbine rotor and which may define a wall against which the pressure fluid exercises its pressure in the direction towards the turbine rotor.

According to a further preferred embodiment, the previously mentioned channel extends through the axle from the outer circumference of the same and axially in the axle to said space. Preferably, the channel comprises at least one radial hole which extends from the outer circumference of the axle to the area of the centre of the axle and at least one axial hole which is connected with said radial hole and ends at said space. The pressure fluid may thus easily be conducted from the outside of the axle and into the closed space in which it may act as a cooling medium.

According to a further preferred embodiment, the balancing member comprises a pressure chamber, which comprises an opening for leading the pressure fluid into the same. Said channel is preferably connected to the pressure chamber. In such a manner, a reliable flow of the pressure fluid/pressure medium to the most downstream positioned rotor disk of the turbine rotor may be achieved.

Further advantages and features of the gas turbine arrangement according to the invention will be clear from the remaining dependent claims and from the following description.

SHORT DESCRIPTION OF THE DRAWINGS

Figure 2:
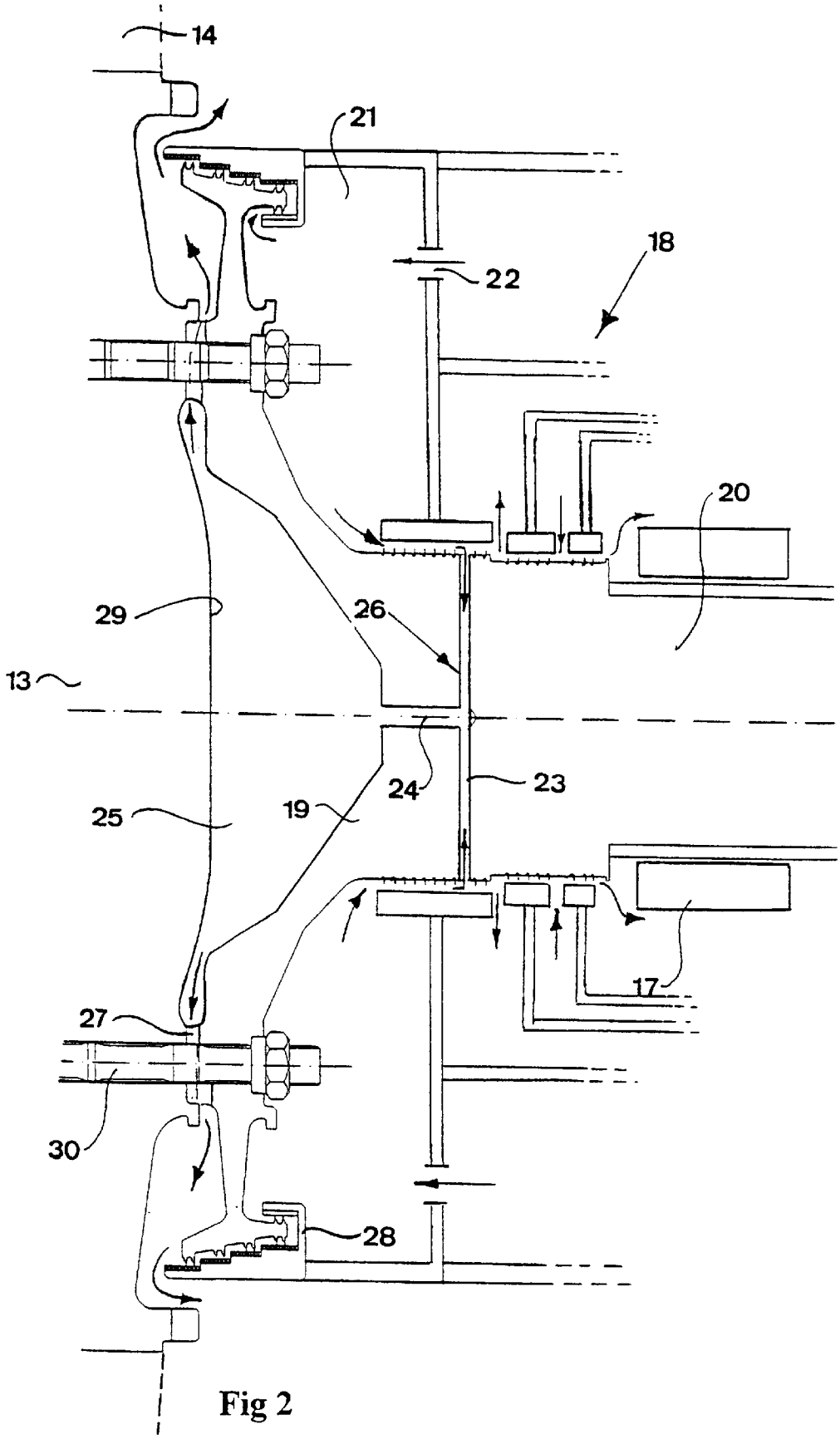

An embodiment of the gas turbine arrangement according to the invention will now be described by means of non-limiting examples with reference to the appendant drawings, on which:

FIG. 1 is a cross-sectional view from the side, showing a gas turbine arrangement according to the invention, FIG. 2 is a cross-sectional view from the side of a part of the gas turbine arrangement according to FIG. 1.

DETAILED DESCRIPTION OF AN EMBODIMENT

The gas turbine arrangement 1 according to the invention, which arrangement is shown in FIG. 1, comprises a compressor 2 and a turbine 3. Furthermore, it comprises a combustion chamber 4, here of an annular kind. At the combustion chamber 4 a plurality of burner members 5 are arranged. These are arranged to cause combustion in the combustion chamber 4 for generating a hot gas in the same. The combustion chamber 4 is in one of its ends provided with an outlet opening via which the generated gas may flow into and run the turbine 3. The compressor 2 primarily has the purpose to deliver a compressor medium, in this case compressed air, to the burner members 5, which use the compressor medium/air for their combustion function.

The compressor 2, the combustion chamber 4 and the turbine 3 are coaxially arranged and connected with each other in that order.

The compressor 2 comprises a stator 6 and a rotor 7. The stator 6 comprises a plurality of guide vane rings 8, which in a known manner comprises a plurality of guide vanes.

The rotor 7 in formed by a plurality of disks 9, which preferably are welded together by means of electron beam welding. Radially outwards of the rotor disks 9, rotor blades 10 are arranged on the respective rotor disk 9.

The turbine 3 comprises a stator 11 and a rotor 12. The rotor 12 comprises a plurality, in this case three, rotor disks 13 on which rings of rotor blades 14 are arranged in a manner known per se.

The compressor rotor 7 is connected with the turbine rotor 12 via a connecting member 15 which extends through the centre of the annular combustion chamber 4. The connecting member 15 is here essentially tube-shaped. The compressor rotor 7 and the turbine rotor 12 are suspended from bearing member 16, 17 which are arranged at the opposite ends of the rotors.

As is clear from FIG. 2, the gas turbine arrangement comprises a balancing member 18, which comprises a disk-shaped piece 19 connected to one end of the turbine rotor 12 and a axle portion 20 connected to the disk-shaped piece. The axle portion 20 extends in the direction from the turbine rotor 12 and is carried by the bearing member 17. The balancing member 18 is by means of axial bolts 30 screwed on and together with the rotor disks 13 of the turbine rotor 12. The balancing member 18 is attached to that end of the turbine rotor 12 which is located downstream.

The balancing member 18 comprises a pressure chamber 21 arranged at that side of the disk-shaped piece 19 which is directed away from the turbine rotor 12. One or more openings 22 are arranged in order to allow a flow of the pressure fluid into the pressure chamber 21. The pressure fluid is preferably compressor air which has been drained off from the compressor and which has a high pressure and a relatively high temperature.

In an area around the outer circumference of the axle portion 20, essentially radially directed holes 23 are drilled in towards the centre of the axle portion 20. Furthermore, in the centre of the axle portion 20, an essentially axial hole 24 extends, which in the area of one of its ends is connected with the radial holes 23 and which at its other end ends in a space 25 which is defined by the last rotor disk of the turbine rotor 12 and the disk-shaped piece 19. The space 25 defines a hollow space. The radial holes 23 are connected with the pressure chamber 21 and form together with the axial hole 24 a channel 26, arranged to conduct pressure fluid/pressure air from the pressure chamber 21 to the space 25.

A plurality of leakage passages 27 are provided along the radial outer circumference of the space 25 in order to allow further transportation of the pressure fluid from the space 25 to a main flow channel of the turbine 3.

Furthermore, sealing members 28 are arranged along the outer circumference of the disk-shaped piece 19 in order to prevent, to an as high extent as possible, that the pressure fluid leaks out between the piece 19 and the wall portion 29 which together with the piece 19 define the pressure chamber 21.

It is evident that a number of modifications and variations of the gas turbine arrangement according to the invention will be obvious to a person skilled in the art without any need for this person to leave the scope of the invention, such as it is defined in the appendant claims.

For example, it would be possible to arrange axial holes in one or more of the rotor disks 13 of the turbine 3 in order to via these holes lead the cooling compressor air on from the space at the last rotor disk to the remaining rotor disks in order to cool these.

What is claimed is:

1. A gas turbine arrangement, comprising:

a compressor with a compressor rotor, a turbine with a turbine rotor and connected with the compressor, and a balancing member connected with the turbine rotor and arranged to counteract axial forces generated by the compressor rotor and the turbine rotor, wherein the balancing member is arranged to be activated by means of a pressure fluid, wherein the arrangement comprises at least one channel which is arranged to lead at least a part of the pressure fluid used for said activation to at least a part of the turbine for influencing the temperature of the same, wherein said part of the turbine is a rotor portion, wherein the balancing member is attached to that end of the turbine rotor which is located downstream and wherein said channel leads to a space which is formed between said end of the turbine rotor and the balancing member.

2. A gas turbine arrangement according to claim 1, wherein the rotor portion is a rotor disk.

3. A gas turbine arrangement according to claim 1, wherein the arrangement comprises at least one leakage passage, arranged to allow leakage of the pressure fluid which is used for said influence of temperature into a main flow channel in the turbine.

4. A gas turbine arrangement according to claim 1, wherein the balancing member comprises an axle portion which is coaxial with the turbine rotor.

5. A gas turbine arrangement according to claim 4, wherein said channel extends through the axle portion, from the outer circumference of the same, and axially in the axle portion to said space.

6. A gas turbine arrangement according to claim 4, wherein said channel comprises at least one radial hole which extends from the outer circumference of the axle portion to the area of the centre of the axle portion, and at least one axial hole which is connected with said radial hole and ends at said space.

7. A gas turbine arrangement according to claim 4, wherein said channel comprises a plurality essentially radial holes, which extend from the outer circumference of the axle portion towards the centre of the same, and at least one axial hole, which is connected with said radial holes and, at one end, ends at said space.

8. A gas turbine arrangement according to claim 1, wherein the balancing member comprises a pressure chamber, which comprises an opening for leading the pressure fluid into the same.

9. A gas turbine arrangement according to claim 1, wherein said influence of temperature is cooling.

* * * * *